US008981637B2

(12) United States Patent
Donners

(10) Patent No.: US 8,981,637 B2
(45) Date of Patent: Mar. 17, 2015

(54) LIGHT SOURCE HAVING PARTICULAR SPECTRAL POWER DISTRIBUTION AS FUNCTION OF WAVELENGTH

(75) Inventor: Maurice Alexander Hugo Donners, Waalre (NL)

(73) Assignee: Koninklijke Philips N.V., Eindhoven (NL)

( * ) Notice: Subject to any disclaimer, the term of this patent is extended or adjusted under 35 U.S.C. 154(b) by 281 days.

(21) Appl. No.: 13/643,570

(22) PCT Filed: Apr. 26, 2011

(86) PCT No.: PCT/IB2011/051804

§ 371 (c)(1),
(2), (4) Date: Oct. 26, 2012

(87) PCT Pub. No.: WO2011/138707

PCT Pub. Date: Nov. 10, 2011

(65) Prior Publication Data

US 2013/0038202 A1 Feb. 14, 2013

(30) Foreign Application Priority Data

May 6, 2010 (EP) ..... 10162113

(51) Int. Cl.
*F21V 9/10* (2006.01)
*H01K 1/32* (2006.01)
(Continued)

(52) U.S. Cl.
CPC . *H01K 1/32* (2013.01); *H01J 61/40* (2013.01); *F21Y 2113/005* (2013.01); *F21Y 2101/02* (2013.01); *F21Y 2105/003* (2013.01)
USPC ..... 313/489; 313/498; 362/231

(58) Field of Classification Search
CPC ..... F21Y 2105/003; F21Y 2113/005; H01J 61/38
USPC ..... 313/485, 489, 498, 638–639; 362/231
See application file for complete search history.

(56) References Cited

U.S. PATENT DOCUMENTS 5,118,985 A * 6/1992 Patton et al. ..... 313/485
5,578,892 A 11/1996 Whitman et al.
(Continued)

FOREIGN PATENT DOCUMENTS

CH 318753 A 1/1957
DE 1141760 12/1962
(Continued)

*Primary Examiner* — Karabi Guharay
(74) *Attorney, Agent, or Firm* — Meenakshy Chakravorty

(57) ABSTRACT

The invention relates to a light source for generating light having a spectral emittance in at least a part of the range of 380 nm to 680 nm. The light has a spectral power distribution E(λ) as a function of the wave-length λ over a first range of 600 nm<=λ<=680 nm, a second range of 505 nm<=λ<=600 nm, and a third range of 380 nm<=λ<=505 nm. A first ratio of the integral power distribution over said first range to that of a range of 380 nm<=λ<=680 nm is given by the relation: Formula (I) wherein $0.65<=P_l<=0.95$, A second ratio of the integral power distribution over said second range to that of a range of 380 nm<=λ<=680 nm is given by the relation: Formula (II) wherein $P_m>=0.08$, A third ratio of the integral power distribution over said third range to that of a range of 380 nm<=λ<=680 nm is given by the relation: Formula (III) wherein $P_s>=0.03$ or $P_s>=0.015$ if $P_l>=0.751$ A respective radiation emission peak in each of the first, second and third wavelength range has a full width half maximum (=FWHM) of at least 12 nm.

10 Claims, 4 Drawing Sheets

(51) Int. Cl.

| | |
|---|---|
| ***H01J 61/40*** | (2006.01) |
| *F21Y 113/00* | (2006.01) |
| *F21Y 101/02* | (2006.01) |
| *F21Y 105/00* | (2006.01) |

(56) References Cited

U.S. PATENT DOCUMENTS

| | | | | |
|---|---|---|---|---|
| 8,134,311 | B2 * | 3/2012 | Donners et al. | 315/326 |
| 8,736,167 | B2 * | 5/2014 | Shibata et al. | 313/637 |
| 2005/0168982 | A1 | 8/2005 | Miller et al. | |
| 2007/0209528 | A1 | 9/2007 | Chang | |
| 2008/0043464 | A1 | 2/2008 | Ashdown | |

FOREIGN PATENT DOCUMENTS

| | | | |
|---|---|---|---|
| FR | 725553 | A | 5/1932 |
| FR | 2695338 | | 3/1994 |
| JP | 08136739 | A | 5/1996 |
| JP | 1021714 | A | 1/1998 |
| JP | 2003098066 | A | 4/2003 |
| JP | 2005504411 | A | 2/2005 |
| JP | 2010501104 | A | 1/2010 |
| WO | 2005072279 | A2 | 8/2005 |
| WO | 2005107336 | A2 | 11/2005 |
| WO | 2010035175 | A1 | 4/2010 |

* cited by examiner

LIGHT SOURCE HAVING PARTICULAR SPECTRAL POWER DISTRIBUTION AS FUNCTION OF WAVELENGTH

FIELD OF THE INVENTION

The invention relates to a light source and the use of the light source for functional lighting.

BACKGROUND OF THE INVENTION

Over the last years, it has became more and more evident that artificial night lighting can have negative consequences for animals, especially for those who are active between dusk and dawn. Of course, different species react differently to different spectra of light; the dependence of these reactions on the spectral light distribution is, however, unknown for the vast majority of animal species, but it is possible to discern certain groups or trends. Many species are disturbed more by short wavelength light. This can have effects on the biological clock of both animals and humans, can influence the adaptation of the eyes to light or dark, or can influence behavior. Insects, for instance, are known to be more attracted by short wavelength light than by light of longer wavelengths. Bats show a lower avoidance of long wavelength light and rodents seem to perceive long wavelength light as darkness.

Another, well known example are sea turtles, where the females will not release their eggs on beaches with a lot of short wavelength light and where the young turtles emerging from the eggs are attracted to short wavelength light from inland instead of crawling towards the sea. The negative effects of lighting near ocean beaches on sea turtles have prompted cities to create ordinances which limit or restrict lighting near ocean beaches. These ordinances may require that light fixtures be turned off in some circumstances. Indeed, in or near protected habitats, all kinds of possible disturbances to animals should be kept to a minimum. But when the possible effects of accidents, involving human lives and direct effects on the environment as in traffic accidents or industrial calamities leading to chemical spills, fires, etc., outweigh the possible environmental effects, necessary precautions should be taken. One of the possible precautions is to have sufficient lighting for work and transport safety.

In an attempt to meet both the demand of lighting being not or hardly disturbing to animals and the demand of safety to humans, WO2005/107336 discloses a luminaire with two light sources. The luminaire is capable of selectively operating either a more or less monochromatic light source, not being disruptive to sea turtles and emitting in a wavelength range between 590 and 650 nm (for example a neon lamp radiating at wavelengths starting at around 585 nm), or an incandescent/fluorescent light source emitting light that is disruptive to sea turtles but pleasant and providing safety to humans. It is a disadvantage of the known light source/luminaire that it is rather expensive and relatively complex of construction. Another disadvantage of the known light source/luminaire is that it produces unpleasant light which only contributes to a relatively low extent to the safety of humans when the luminaire operates said monochromatic light source.

SUMMARY OF THE INVENTION

It is an object of the invention to counteract at least one of the above-mentioned disadvantages. To achieve this, the light source according to the invention has the following features for generating light having a spectral emittance in at least a part of the range of 380 nm to 680 nm:

the light has a spectral power distribution E(λ) as a function of the wavelength λ; the light source comprises a lighting control element and at least one additional lighting control element, the lighting control element and the at least one additional lighting control element being set to obtain generated light with a power distribution over a first range of 600 nm<=λ<680 nm, a second range of 505 nm<=λ<600 nm, and a third range of 380 nm<=λ<505 nm, wherein a first ratio of the integral power distribution over said first range to that of a range of 380 nm<=λ<=680 nm is given by the relation:

$$\frac{\int_{600}^{680} E(\lambda)\,d\lambda}{\int_{380}^{680} E(\lambda)\,d\lambda} = P_1 \text{ wherein } 0.65 <= P_1 <= 0.95,$$

a second ratio of the integral power distribution over said second range to that of a range of 380 nm<=λ<=680 nm is given by the relation:

$$\frac{\int_{505}^{600} E(\lambda)\,d\lambda}{\int_{380}^{680} E(\lambda)\,d\lambda} = P_m \text{ wherein } P_m >= 0.08,$$

a third ratio of the integral power distribution over said third range to that of a range of 380 nm<=λ<=680 nm is given by the relation:

$$\frac{\int_{380}^{505} E(\lambda)\,d\lambda}{\int_{380}^{680} E(\lambda)\,d\lambda} = P_s \text{ wherein } P_s >= 0.03 \text{ or } P_s >= 0.015 \text{ if } P_1 <= 0.75$$

each of the first, second and third range has a spectral coverage by the lighting control element respectively the at least one additional lighting control element of at least 10%. In a wavelength range between 680 nm and 780 nm of visible radiation, an emission of spectral power should be relatively low, i.e. 25% or less relative to the spectral power emitted from 380 nm to 780 nm, to render the lamp to be efficient. Preferably said emission shall not be more than 10% relative to the spectral power emitted from 380 nm to 780 nm in order to anticipate on future environmental demands on lamp efficiency. Most preferably the emitted spectral power in the range 680 nm to 780 nm is practically absent, for example 2% or less relative to the spectral power emitted from 380 nm to 780 nm.

Spectral coverage is to be understood as the fraction of a specific range in which the lighting control elements have an emission. A lighting control element is considered to have an emission at a certain wavelength if the measured intensity at said wavelength is at least ten times the amount of the background noise signal at that wavelength as measured when the light source is switched off. The present invention provides a light source that controls the emitted light so as to offer a sufficient level of vision to humans for performing their tasks in a safe manner, and that simultaneously results in relatively very little disturbance to short wavelength-sensitive animals. For humans, lighting needs to have certain qualities to be effective. The ability to recognize colors is very important in work safety, for example in recognizing safety and warning signs, localizing safety equipment, recognizing tubing and product labels and for observing processes. Besides this, a sufficient level of color rendering also aids in recognizing people and enhances spatial orientation, both contributing to a general feeling of comfort and safety, but particularly important in emergency situations. For white light, or at least light with a color point relatively close to the black body line, and with a moderate to good color rendering, the CIE defined a measure for color rendering quality, the CRI, or Ra. In defining the Ra, an incandescent lamp was defined as having a Ra of 100 and a now probably obsolete "warm white" calcium halophosphate fluorescent lamp was defined to have a Ra of 50. The CIE defines the 'color rendering properties' of a light source as the 'Effect of a light source on the color appearance of objects in comparison with their color appearance under a reference illuminant for specified conditions', "CIE-Publikation Nr. 13.3, 1995, Method of Measuring and Specifying Colour-rendering Properties of Light Sources". Although this is of great practical importance and of great esthetical value in many cases, in many applications it is sufficient for humans to discern and recognize certain colors, without the need to compare or differentiate between different shades of similar colors. A sufficient level of color recognition by humans in this respect means the ability of humans to recognize, and distinguish between, the basic colors of objects illuminated by a light source. If, for example, the spectral coverage in the third range is increased from the above-mentioned at least 10% to at least 20% coverage, the color rendering Ra is increased by about 20 points and safety to humans is increased. The basic colors are generally seen as the color category comprising for example black, grey, white, pink, red, orange, yellow, green, blue, purple, brown, and azure. To offer good color recognition the spectrum does not have to be completely filled over the complete range of light wavelengths, although a certain distribution in the spectral power distribution is preferred to make each color visible and to counteract metamerism. In the emission spectrum of the lamp, the minimal values for the second ratio $P_m$ is at least 0.08 and the third ratio $P_s$ at least 0.015 or 0.03, depending on the first ratio $P_l$. These minimal values ensure that sufficient radiation is present in the medium, i.e. 505 nm to 600 nm (green to orange), and short, i.e. 380 nm to 505 nm (indigo to green) wavelength ranges to attain the possibility of color recognition, in combination with the specified minimum spectral coverage value. If both the $P_s$ and $P_l$ ratios become too small, the medium wavelength range $P_m$ is too dominant and contravenes with color recognition. Therefore, the lower limit of the amount of emission in the short wavelength range $P_s$ should be balanced against the emission in the medium wavelength range $P_m$ and against the emission in the long wavelength range $P_l$, with respect to color recognition and disturbance to animals. This is attained by the shift in the criterion of $P_s$>=0.03 for $P_l$>=0.65 to Ps>=0.015 for $P_l$>=0.75. In terms of CRI expressed as $R_{a8}$, this ensures a value of at least 35. To counteract $P_m$ being too dominant, the light source preferably is characterized in that $P_m$<=0.32, more preferably $P_m$<=0.25, even more preferably $P_m$<=0.20. Emission spectra of lamps wherein a first ratio $P_l$ of the integral power distribution over said first range of 600 nm<=λ<=680 nm (orange to red range) to that of a range of 380 nm<=λ<=680 nm (wavelength range visible to human) is higher than 0.9 will result in insufficient possibilities of color recognition.

An embodiment of the light source is characterized in that 0.65<=$P_l$<=0.85, preferably 0.70<=$P_l$<=0.85. Based on our current insights into the influence of spectral power distribution on the attractiveness of artificial light to insects, it is seen that $P_l$>=0.65 of the power of the emitted light between 600 and 680 nm, would result in a reduction in insect attraction by 50%, compared to the most commonly used white light sources, with a $P_l$ between 0.20 and 0.40. A further increase in long wavelength radiation $P_l$>=0.70 would decrease insect attraction to below 10%. For the less general, more light sensitive bats, like the Myotis species, $P_l$>=0.70 allows formulating a spectral power distribution which, based on our current knowledge, does not result in a significant disturbance, but does allow reaching street lighting levels corresponding to the lower light level classes S5, S6, A2, A3. Taking into account the other requirements on the spectral power distribution stated here, with $P_l$>=0.80 a spectrum can be obtained which, compared at equal flux levels, is less attractive to insects than a monochromatic Low Pressure Sodium lamp, yet with a color rendering index of more than 60.

Another embodiment of the light source is characterized in that the total flux of the light source is at least 100 lm, preferably at least 250 lm, more preferably at least 750 lm. A lumen package of 100 lm is suitable for lighting specific points in a professional setting, e.g. a warning sign, an entrance or an obstacle. From 250 lm, such a light source could be used for lighting in public or private gardens. At fluxes higher than 750 lm, for example up to the order of magnitude of 100000 lm, such light sources/luminaires can be applied for street, road and area lighting.

In an embodiment, the light source is characterized in that it comprises a plurality of LEDs as the first lighting control element, said first lighting control element being chosen from the group consisting of a red-orange LED and a red-LED, and the light source comprises an additional plurality of LEDs as the at least one additional lighting control element, said at least one additional lighting control element being chosen from the group consisting of a blue LED, a green LED and an amber LED. LEDs are small lighting elements available in a great variety of emission colors. The spectral emission of the light source can be easily chosen by selection of the various colors emitted by the different LEDs and appropriate numbers thereof. The light source can be further characterized in that the light source comprises at least one further additional lighting control element consisting of at least one LED not selected from either the group of the first lighting control element or the additional lighting control element. By selecting more differently colored LEDs a broader coverage of the spectrum from 380-680 nm is attainable and thus an improvement of the CRI and/or color recognition is attainable. Alternatively, a light source is characterized in that the light source comprises a plurality of LEDs as the first lighting control element, said first lighting control element being chosen from the group consisting of a red-orange LED and a red-LED, and the light source comprises an additional plurality of LEDs as the at least one additional lighting control element, said at least one additional lighting control element being chosen from the group consisting of a cool white LED (CW) and a warm white LED. Alternatively this is also attainable with other whites, for example neutral white LEDs.

An alternative way to obtain a broader coverage of the spectrum is by using lighting control elements having an increased full width at half maximum (FWHM) of at least one significant emission peak in each of the first, second and third wavelength range. Significant in this respect means that measured spectral intensity at said peak are at least hundred times the level of the measured background noise signal. A minimal starting value of 12 nm for the FWHM is accepted, however, preferably the FWHM is at least 20 nm. Preferably the radiation should be emitted so as to be evenly distributed over the full ranges, without having any discernable peaks, as this would increase the color recognition possibilities.

An embodiment of the light source is characterized in that the light source is a low-pressure mercury vapor discharge lamp comprising a discharge vessel, the discharge vessel enclosing, in a gastight manner, a discharge space provided with an inert gas and mercury and comprising discharge means for maintaining a discharge in the discharge space, at least a part of a wall of the discharge vessel being provided with a luminescent layer comprising a mixture of a red emitting phosphor as the first lighting control element, and at least two phosphors chosen from a blue emitting phosphor, a green emitting phosphor, an amber emitting phosphor and a red-orange emitting phosphor as the one additional lighting control element and a further additional lighting control element. The blue phosphor preferably is $BaMgAl_{10}O_{17}$:Eu (BAM), $Sr_5(PO_4)_3Cl$:Eu (SCAP) and/or $Sr_4Al_{14}O_{25}$:Eu (SAE), the green phosphor preferably is $LaPO_4$:Ce,Tb (LAP), $Sr_4Al_{14}O_{25}$:Eu and/or $BaMg_2Al_{16}O_{27}$:Eu,Mn (BAM-green), the amber phosphor preferably is $Sr_{10}(PO_4)_6F_2$:Sb (SHS), the red-orange phosphor preferably is $Y_2O_3$:Eu (YOX), and the red phosphor preferably is $YVO_4$:Eu ($YVO_4$) and/or $Mg_4GeO_6$:Mn (MGM). These phosphors are cheap, well-known and widely applied in fluorescent lamps. Presently, a fluorescent lamp is a cheap alternative to a light source equipped with LEDs.

An embodiment of the light source is characterized in that the light source is a high pressure ceramic metal halide lamp as the lighting control element provided with an interference filter as the at least one additional lighting control element which at least partly, but not totally, reflects or absorbs light of a wavelength $\lambda$ in the range of 380 nm$\leq\lambda\leq$600 nm and a cut-off wavelength in the range of 590-610 nm, so as to prevent, at least partly, the light in said range from reaching the surroundings of the light source, said interference filter preferably comprising alternating layers of $Fe_2O_3/SiO_2$ and $SiO_2$ provided on at least a part of an outer side of the lamp vessel.

General Electric Lighting Systems introduced two filters to be used together with High Pressure Sodium (=HPS) lamps to reduce the disturbing effect to sea turtles. Both were high-pass filters, with a cut-off at 530 nm (filter type #2422), or at 570 nm (filter type NLW). Below 520 or 560 nm, respectively, these filters completely blocked all light, reaching a transmittance of about 90% at 650 nm. Research has shown that the application of such filters together with an HPS lamp does not fully have the desired effect on sea turtles. The instant invention indicates that the cut-off wavelengths used in the lamps of GE are too short and should be at about 600 nm or somewhat higher to yield both the desired effect for sea turtles and safety effects for humans. Halogen lamps with similar filters were disclosed by GE in U.S. Pat. No. 5,578,892. However, the spectra emitted by these lamps are characterized by a value of $P_l$ of only about 0.36. Besides that these lamps apparently did not have the required biological effect, a considerable amount of energy is emitted at wavelengths between 680 nm and 780 nm, where they contribute little to the human perception of light (intensity), making these lamps much less energy efficient than the light sources described here. To preferably fulfill the future requirements for energy efficiency, no more than 10% of the total emitted spectral power should be emitted between 680 nm and 780. To illustrate this boundary condition typical energy efficient lamps, like modern fluorescent lamps or LED lighting, fulfill this requirement, whereas typical incandescent or halogen lamps have much higher, inappropriate values.

The present invention provides a light source that predominantly emits light of predetermined, specific longer wavelengths that are hardly visible to, or at least hardly influencing the natural behavior of, short wavelength sensitive animals, such as both baby and adult sea turtles, insects, bats or rodents and other small mammals, yet still within the human visible spectrum and effective in illuminating outdoor living areas. However, to maintain a relatively simple and cheap construction of the light source and the luminaire, this spectrum preferably should be emitted by a single system, for example, having one mounting point, for example a socket, lamp post, mounting bracket, or standing foot, and one electrical power connection. The aim is to provide functional lighting, for example for working, reading, driving, inspecting, sports, etc., hence the use of the light source is less designed for lighting aimed at attaining an esthetical effect, such as decorative, festive, seasonal or architectural/city beautification lighting. The light source/luminaire should be designed or set to emit said type of spectrum, but it could also have the option to change to a different spectrum, e.g. by adding white light, or light in the short and medium wavelength ranges, or by dimming the light in the long wavelength range, in order to make the light more white for human safety when that takes priority over the ecological disturbance or if at a certain time or in a certain period the risk of this disturbance is absent (e.g. during hibernation of the affected species).

US2005/0168982 discloses a low pressure sodium discharge lamp, having a monochromatic line emission at 589 nm to protect wildlife. This lamp has the well-known disadvantages that it does not offer any color recognition, that it produces unpleasant light, and that it contributes to a relatively low extent to safety of humans during operation of the monochromatic light source; moreover, the emitted wavelength is too short to sufficiently limit the effects on the aforementioned animals. Therefore it has been generally proposed to mix its light with that of another source, indicating that color vision is possible in low pressure sodium vapor light mixed with other light. However, the necessary information as to which wavelengths to add and in what proportion to reach a sufficient level of color recognition with the smallest possible extra disturbance to the surrounding eco system, is never given. Also for some animals, e.g. for the Squirrel Treefrog (*Hyla squirella*) nocturnal color vision is important in mate choice and male-male competition. Obviously, it is at least questionable whether a standard low pressure sodium lamp would offer the desired level of color recognition.

BRIEF DESCRIPTION OF THE DRAWINGS

The invention will now be explained in greater detail by means of the examples and the schematic drawings, in which.

DETAILED DESCRIPTION OF EMBODIMENTS

Figure 1A:
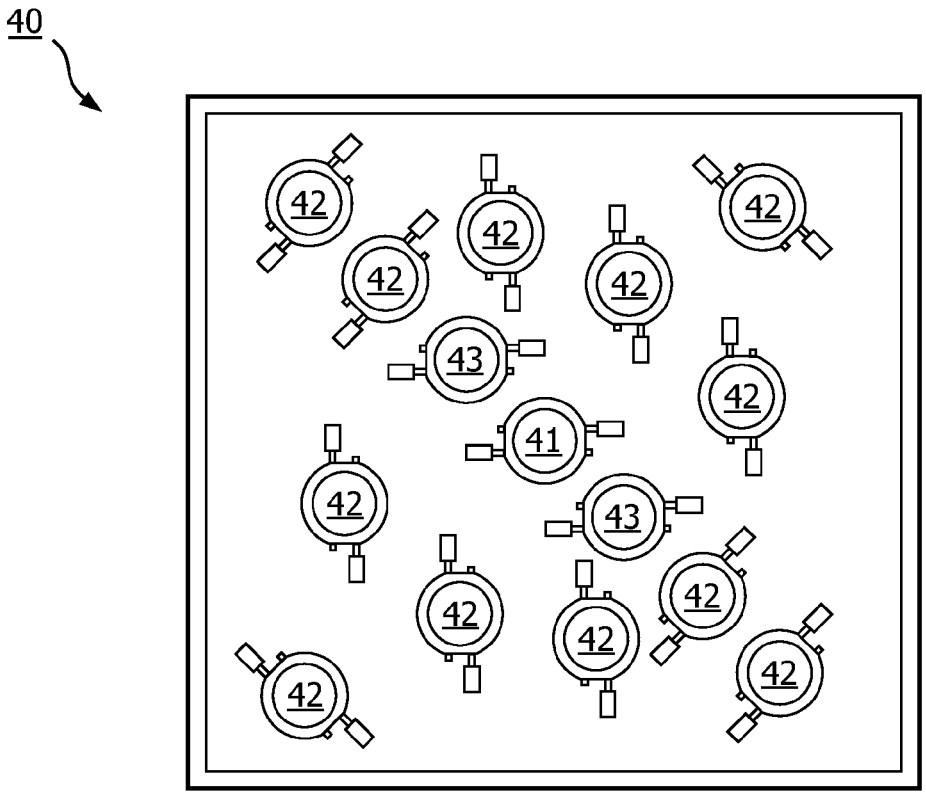
FIG. 1A shows a cross-sectional view of a first embodiment of the light source according to the invention.
Figure 1B:
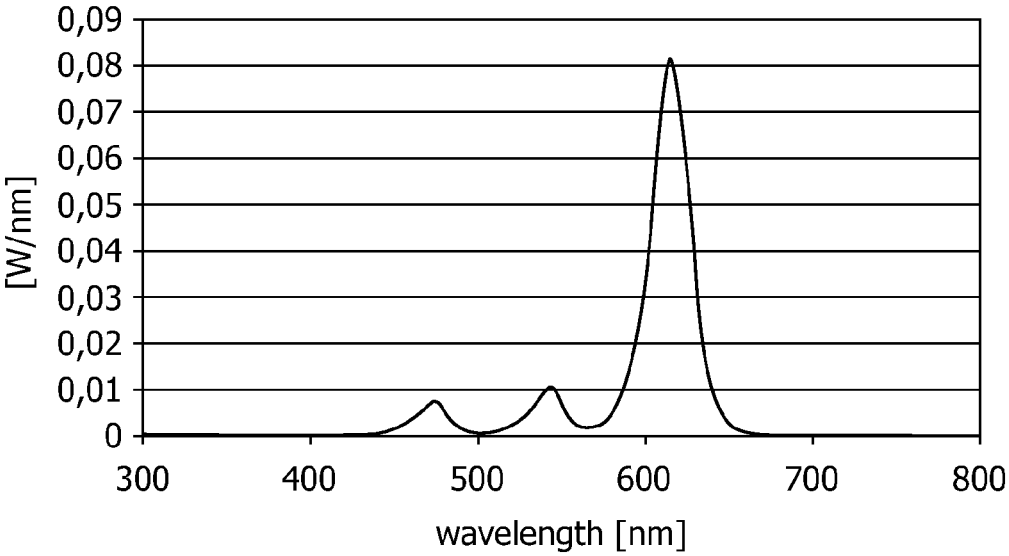
FIGS. 1B and 1C show emission spectra built up by using respectively LEDs without phosphor conversion and phosphor-converted LEDs.
Figure 1C:
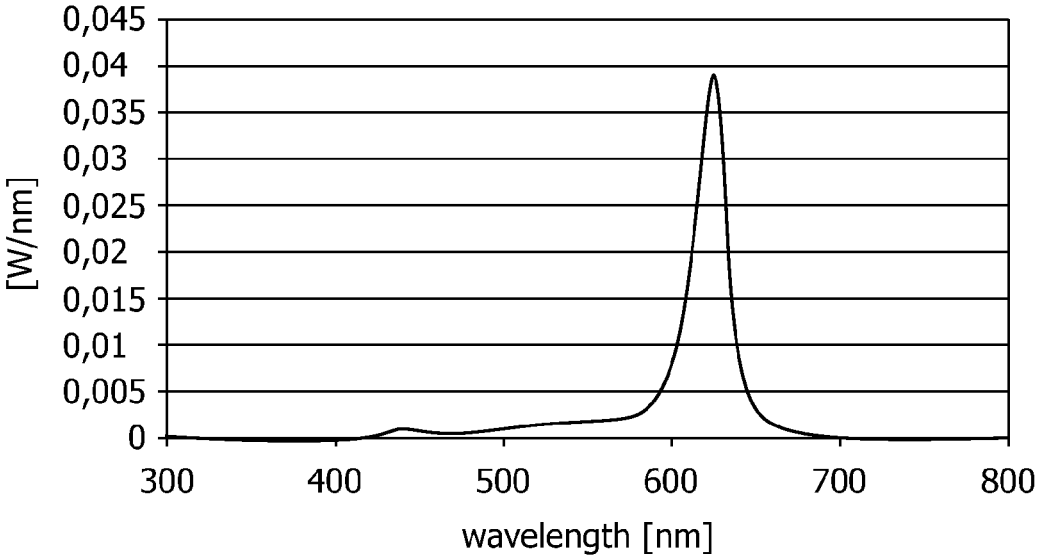

FIG. 1A schematically shows a first embodiment of a light source 40 according to the invention. The light source comprises a plurality of LEDs comprising, as an example, one blue light-emitting diode (LED) 41, twelve red LEDs 42 and two green LEDs 43. In this embodiment, all LEDs are Luxeon™ I LEDs from Philips Lumileds Lighting Company™. In an alternative embodiment, different LEDs can be used, for example CREE XPE or XRE LEDs, or Luxeon Rebels. The LED 41, the plurality of LEDs 42 and the plurality of LEDs 43 can preferably be dimmed in order to adjust the light output of the respective LEDs. The light source 40 has a light-transmissive exit window (not shown) facing the light emitting side of the LED, and a rear side (not shown) facing away from the light emitting side of the LED. The rear side preferably has a specular surface on the side facing the exit window. The light generated by the LEDs 41, 42, 43 is homogeneously mixed inside the light source 40 and emitted via the exit window. The emitted light has a color-rendering index $R_a$ of about 30 and the parameter $P_l$, being the ratio of the integral spectral power distribution over a first range of 600 nm≤λ≤680 nm to that of a total range of 380 nm≤λ≤680 nm, is 0.72. Tables 2-4 show alternative embodiments of the light source 40 in terms of the ratio of the number (#) of red, red-orange, amber, green and blue LEDs, the luminous flux of the light source, the color-rendering index $R_a$ and the parameters $P_l$, $P_m$, and $P_s$ of the light generated by the light source. The exact total number of LEDs in a light source 40 depends on the required light output and on the light output of the individual LEDs. Given the number of LEDs for each color in the light source 40, one can calculate the lamp characteristics, for example spectral power distribution, luminous flux, efficacy, general color-rendering index $R_a$ and parameter $P_l$. Table 1 gives the properties of the various LEDs used in the calculations. When designing the light source 40, a maximum value of the parameter $P_l$ and a minimum value of the general color-rendering index $R_a$ of the light generated by the light source 40, are chosen. In addition, a minimum value of the power usage is chosen in order to balance the cost of the light source 40 relative to its light output. Given the spectral power distribution for each individual LED, the required number of specifically colored LEDs is determined via an iterative procedure. FIG. 1B shows a resulting spectral power distribution, i.e. the output power in W $nm^{-1}$ versus the wavelength λ in nm of the generated light, which is built up using 'direct' LEDs, i.e. LEDs without phosphor conversion, with $P_L$=82%. The light source has a ratio of 1:5:38 in the number of blue, green and red LEDs, as specified in Table 1. The light source emits light with a specific luminous flux of about 1870 lm. The general color-rendering index $R_a$ is 44. The spectrum as generated by the light source has a spectral coverage for the first range of about 62%, a spectral coverage for the second range of practically 100%, and for the third range of about 40%. FIG. 1C shows a resulting spectral power distribution, i.e. the output power in W $nm^{-1}$ versus the wavelength λ in nm of the generated light, which is built up using phosphor-converted LEDs, i.e. blue LEDs with a $Y_3Al_5O_{12}$:Eu phosphor (=YAG), with $P_L$=81%. The light source has a ratio of 4:18 in the number of warm-white and red-orange LEDs, as shown in Table 5. The light source emits light with a specific luminous flux of about 1000 lm. The general color-rendering index $R_a$ is 76. The spectrum as generated by the light source has a spectral coverage for the first range of about 67%, a spectral coverage for the second range of practically 100%, and for the third range of about 57%. Wavelengths above 680 nm hardly contribute to the color rendering index Ra and hence spectral coverage at longer wavelengths than 680 nm is considered irrelevant in this case.

TABLE 1

Properties of LEDs used in calculations and experiments

| Color | Optical power [W] | Peak wavelength [nm] | FWHM [nm] |
|---|---|---|---|
| Blue | 0.387 | 475 | 24 |
| Green | 0.107 | 545 | 22 |
| Amber | 0.056 | 588 | 26 |
| Red-Orange | 0.118 | 615 | 24 |
| Red | 0.159 | 625 | 24 |
| Cool white | 0.333 | CCT 6500K | — |
| Warm white | 0.223 (74 lm) | CCT 3800K | — |

TABLE 2

Embodiments with $0.65 < P_1 < 0.70$

| Blue | Green | Amber | red-orange | red | Flux | CRI | lm/led | $P_s$ | $P_m$ | $P_l$ |
|---|---|---|---|---|---|---|---|---|---|---|
| 0.5 | 2.5 | 4 | 8 | 7 | 900 | 80 | 40.9 | 0.07 | 0.25 | 0.68 |
| 1 | 1 | 4 | 8 | 8 | 855 | 70 | 38.9 | 0.13 | 0.18 | 0.68 |
| 0.5 | 1.5 | 6 | 6 | 8 | 855 | 82 | 38.9 | 0.07 | 0.24 | 0.68 |
| 1 | 0 | 6 | 6 | 9 | 810 | 55 | 36.8 | 0.13 | 0.18 | 0.69 |
| 0.5 | 3.5 | 0 | 13 | 5 | 964 | 71 | 43.8 | 0.07 | 0.23 | 0.70 |
| 1 | 1 | 11 | 31 | 0 | 1665 | 47 | 37.8 | 0.08 | 0.27 | 0.65 |
| 0.5 | 2.5 | 0 | 19 | 0 | 937 | 77 | 42.6 | 0.07 | 0.24 | 0.69 |
| 0.5 | 1 | 6 | 6 | 8.5 | 841 | 77 | 38.2 | 0.07 | 0.22 | 0.70 |

TABLE 3

Embodiments with $0.70 < P_1 < 0.80$

| Blue | Green | Amber | red-orange | red | Flux | CRI | lm/led | $P_s$ | $P_m$ | $P_l$ |
|---|---|---|---|---|---|---|---|---|---|---|
| 0.5 | 2.5 | 2 | 10 | 7 | 919 | 77 | 41.7 | 0.07 | 0.22 | 0.71 |
| 1 | 2 | 2 | 1 | 16 | 901 | 54 | 41.0 | 0.11 | 0.14 | 0.74 |
| 0.5 | 2.5 | 1 | 13 | 5 | 928 | 77 | 42.2 | 0.07 | 0.22 | 0.71 |
| 0.5 | 2.5 | 1 | 13 | 6 | 967 | 77 | 42.0 | 0.07 | 0.21 | 0.73 |
| 1 | 1 | 12 | 12 | 18 | 1656 | 66 | 37.6 | 0.07 | 0.20 | 0.72 |
| 1 | 1 | 11 | 16 | 15 | 1665 | 63 | 37.8 | 0.07 | 0.21 | 0.72 |
| 0.5 | 2.5 | 0 | 13 | 6 | 937 | 75 | 42.6 | 0.07 | 0.19 | 0.74 |

TABLE 3-continued

| Embodiments with $0.70 < P_1 < 0.80$ | | | | | | | | | | |
|---|---|---|---|---|---|---|---|---|---|---|
| Blue | Green | Amber | red-orange | red | Flux | CRI | lm/led | $P_s$ | $P_m$ | $P_l$ |
| 1 | 0 | 3 | 3 | 15 | 838 | 49 | 39.9 | 0.12 | 0.10 | 0.78 |
| 1 | 1 | 1 | 1 | 18 | 883 | 59 | 40.1 | 0.11 | 0.09 | 0.79 |
| 1 | 1 | 1 | 1 | 19 | 923 | 60 | 40.1 | 0.10 | 0.09 | 0.80 |
| 1 | 4 | 5 | 40 | 20 | 2835 | 71 | 40.5 | 0.04 | 0.18 | 0.77 |
| 1 | 4 | 5 | 47 | 20 | 3113 | 67 | 40.4 | 0.04 | 0.18 | 0.78 |
| 1 | 4 | 5 | 55 | 22 | 3511 | 63 | 40.3 | 0.04 | 0.18 | 0.79 |

TABLE 4

| Embodiments with $0.80 < P_1 < 0.95$ | | | | | | | | | | |
|---|---|---|---|---|---|---|---|---|---|---|
| Blue | Green | Amber | red-orange | red | Flux | CRI | lm/led | $P_s$ | $P_m$ | $P_l$ |
| 1 | 1 | 1 | 1 | 20 | 963 | 62 | 40.1 | 0.10 | 0.09 | 0.81 |
| 1 | 4 | 5 | 62 | 26 | 3948 | 59 | 40.3 | 0.03 | 0.17 | 0.80 |
| 1 | 4 | 5 | 72 | 30 | 4505 | 54 | 40.2 | 0.03 | 0.16 | 0.81 |
| 1 | 4 | 0 | 4 | 55 | 2644 | 69 | 41.3 | 0.04 | 0.10 | 0.86 |
| 1 | 4 | 0 | 4 | 80 | 3639 | 67 | 40.9 | 0.03 | 0.08 | 0.89 |
| 1 | 2 | 0 | 25 | 75 | 4142 | 43 | 40.2 | 0.03 | 0.09 | 0.89 |

Alternatively, a combination of long wavelength radiating LEDs and white (phosphor converted) LEDs can be used, e.g. CW and WW LEDs listed in table 1. Calculations including phosphor converted LEDs are given in Table 5.

TABLE 5

| Embodiments using direct and phosphor converted LEDs. | | | | | | | | | | |
|---|---|---|---|---|---|---|---|---|---|---|
| Blue | red-or-ange | red | cw | ww | Flux | CRI | lm/led | $P_s$ | $P_m$ | $P_l$ |
| | 20 | | 2 | | 996 | 72.6 | 45.25 | 0.09 | 0.23 | 0.67 |
| | | 19 | 3 | | 898 | 48.2 | 40.8 | 0.10 | 0.15 | 0.74 |
| | 18 | | | 4 | 1011 | 76 | 45.95 | 0.06 | 0.25 | 0.68 |
| | 19 | | | 3 | 977 | 67.7 | 44.4 | 0.05 | 0.23 | 0.71 |
| | | 20 | 2 | | 829 | 57.2 | 37.67 | 0.07 | 0.12 | 0.80 |
| | | 18 | | 4 | 861 | 59.5 | 39.12 | 0.05 | 0.14 | 0.80 |
| | 20 | | | 2 | 943 | 53.7 | 42.85 | 0.03 | 0.21 | 0.75 |
| | 21 | | | 1 | 909 | 32.4 | 41.31 | 0.02 | 0.19 | 0.79 |
| | 21 | | | 2 | 983 | 52 | 42.72 | 0.03 | 0.21 | 0.75 |
| | 21 | | 1 | | 935 | 49.5 | 42.51 | 0.05 | 0.20 | 0.75 |
| 1 | 120 | | 1 | | 4901 | 17.4 | 40.18 | 0.04 | 0.17 | 0.79 |
| | | 25 | | 1 | 1069 | 42.6 | 41.1 | 0.01 | 0.07 | 0.91 |
| | | 20 | | 2 | 943 | 67.6 | 42.9 | 0.02 | 0.10 | 0.87 |

The light source then comprises a plurality of LEDs as the first lighting control element, said first lighting control element being chosen from the group consisting of a red-orange LED and a red-LED, and the light source comprises an additional plurality of LEDs as the at least one additional lighting control element, said at least one additional lighting control element being chosen from the group consisting of a cool white LED (CW) and a warm white LED (WW).

Figure 2:
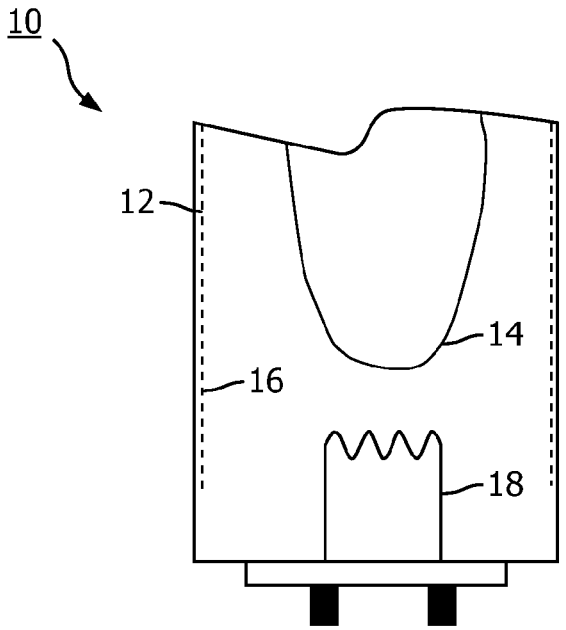
FIG. 2 shows a cross-sectional view of a second embodiment of the light source according to the invention.

In FIG. 2 a portion of a second embodiment of the light source according to the invention is shown and comprises a low pressure mercury discharge lamp as the lighting control element provided with a phosphor layer as the at least one additional lighting control element. FIG. 2 only shows one end portion of the light source 10 actually; the light source 10 comprises two mutually opposite, identical end portions, each sealing one end of an elongated discharge vessel 12. The light sources 10 are low-pressure gas discharge lamps comprising a light-transmitting discharge vessel 12 which encloses a discharge space 14 in a gastight manner. The discharge space 14 comprises a gas filling of mercury and a buffer gas, for example, argon or xenon. The low-pressure gas discharge lamp 10 further comprises discharge means 18 for maintaining a discharge in the discharge space 14. The discharge means 18 couple energy into the discharge space 14, for example, via capacitive coupling, inductive coupling, microwave coupling, or via electrodes. Electrons and ions in the gas filling of the discharge space 14 collide with the mercury compound in the gas filling. Due to the collision, the mercury atoms are excited and subsequently emit light, mainly ultraviolet light at a wavelength of approximately 254 nm. The low-pressure gas discharge lamp 10 comprises a luminescent layer 16 of a luminescent material which absorbs ultraviolet light and subsequently converts the absorbed ultraviolet light into visible light.

The appropriate spectra for the lamp according to the invention can be arrived at by a fluorescent lamp, using an appropriate combination of phosphors in the luminescent layer. Given the amount of phosphor material in weight % for each phosphor emitting a specific color in the light source 10, one can calculate the lamp characteristics, for example spectral power distribution, luminous flux, efficacy, general color-rendering index $R_a$ and parameter $P_l$. When designing the light source 10, a maximum value of the parameter $P_l$ and a minimum value of the general color-rendering index $R_a$ of the light generated by the light source 10, are chosen. Possible combinations of phosphors are given in table 6.

TABLE 6

Examples of combinations of phosphors for low pressure mercury discharge lamps (= fluorescent lamps).

| color | blue [wght ratio] | [% wght] | green [wght ratio] | [% wght] | amber [wght ratio] | [% wght] | red-orange [wght ratio] | [% wght] | red [wght ratio] | [% wght] | Flux | CRI |
|---|---|---|---|---|---|---|---|---|---|---|---|---|
| phosphor | BAM | | LAP | | | | YOX | | | | | |
| ratio | 3 | 1.55 | 8.5 | 4.39 | | | 182 | 94.06 | | | 455k | 72 |
| ratio | 3 | 0.61 | 14 | 2.85 | | | 475 | 96.54 | | | 905k | 76 |
| ratio | 3 | 0.36 | 8.5 | 1.02 | | | 825 | 98.63 | | | 1384k | 62 |
| ratio | 3 | 0.03 | 8.5 | 0.09 | | | 9120 | 99.87 | | | 1915k | 41 |
| phosphor | BAM | | BAM-green | | | | YOX | | | | | |
| ratio | 2.9 | 0.57 | 8.4 | 1.66 | | | 494 | 97.76 | | | 1190k | 57 |
| ratio | 2.9 | 0.36 | 8.4 | 1.05 | | | 787 | 98.58 | | | 1800k | 66 |
| ratio | 2.9 | 0.17 | 8.4 | 0.50 | | | 1670 | 99.33 | | | 36500k | 64 |
| ratio | 2.9 | 0.05 | 8.4 | 0.15 | | | 5700 | 99.80 | | | 119312k | 40 |
| phosphor | BAM | | SAE | | | | YOX | | | | | |
| ratio | 2.9 | 0.55 | 8.4 | 1.58 | | | 520 | 97.87 | | | 1272k | 53 |
| ratio | 2.9 | 0.34 | 8.4 | 0.99 | | | 836 | 98.67 | | | 1931k | 64 |
| ratio | 2.9 | 0.16 | 8.4 | 0.48 | | | 1750 | 99.36 | | | 3837k | 64 |
| ratio | 2.9 | 0.00 | 8.4 | 0.01 | | | 64500 | 99.98 | | | 135227k | 40 |
| phosphor | SCAP | | LAP | | | | YOX | | | | | |
| ratio | 2.9 | 1.26 | 8.4 | 3.66 | | | 218 | 95.07 | | | 556k | 71 |
| ratio | 2.9 | 0.80 | 8.4 | 2.32 | | | 350 | 96.87 | | | 831k | 74 |
| ratio | 2.9 | 0.39 | 8.4 | 1.12 | | | 741 | 98.50 | | | 1649k | 66 |
| ratio | 2.9 | 0.01 | 8.4 | 0.04 | | | 22800 | 99.95 | | | 47763k | 41 |
| phosphor | SCAP | | LAP | | | | | | MGM | | | |
| ratio | 5.8 | 4.52 | 19.6 | 15.26 | | | | | 103 | 80.22 | 398k | −10 |
| ratio | 2.9 | 3.70 | 8.4 | 10.73 | | | | | 67 | 85.57 | 216k | −41 |
| ratio | 2.9 | 2.67 | 8.4 | 7.73 | | | | | 97.3 | 89.59 | 269k | −65 |
| ratio | 2.9 | 1.64 | 8.4 | 4.76 | | | | | 165 | 93.59 | 387k | −77 |
| ratio | 2.9 | 0.68 | 8.4 | 1.96 | | | | | 418 | 97.37 | 827k | −41 |
| phosphor | BAM | | LAP | | | | | | YVO4 | | | |
| ratio | 2.9 | 1.77 | 8.4 | 5.11 | | | | | 153 | 93.12 | 384k | 59.8 |
| ratio | 2.9 | 1.12 | 8.4 | 3.25 | | | | | 247 | 95.63 | 575k | 66.8 |
| ratio | 2.9 | 0.53 | 8.4 | 1.55 | | | | | 532 | 97.92 | 1154k | 67 |
| phosphor | BAM | | LAP | | SHS | | YOX | | | | | |
| ratio | 2.9 | 0.71 | 8.4 | 2.06 | 2.8 | 0.69 | 393 | 96.54 | | | 1034k | 72 |
| ratio | 2.9 | 0.34 | 8.4 | 0.99 | 2.8 | 0.33 | 835 | 98.34 | | | 1539k | 75 |
| ratio | 2.9 | 0.14 | 8.4 | 0.40 | 5.6 | 0.26 | 2100 | 99.20 | | | 4741k | 67 |
| ratio | 2.9 | 0.01 | 8.4 | 0.02 | 2.8 | 0.01 | 38000 | 99.96 | | | 79650k | 40.7 |

Figure 3A:
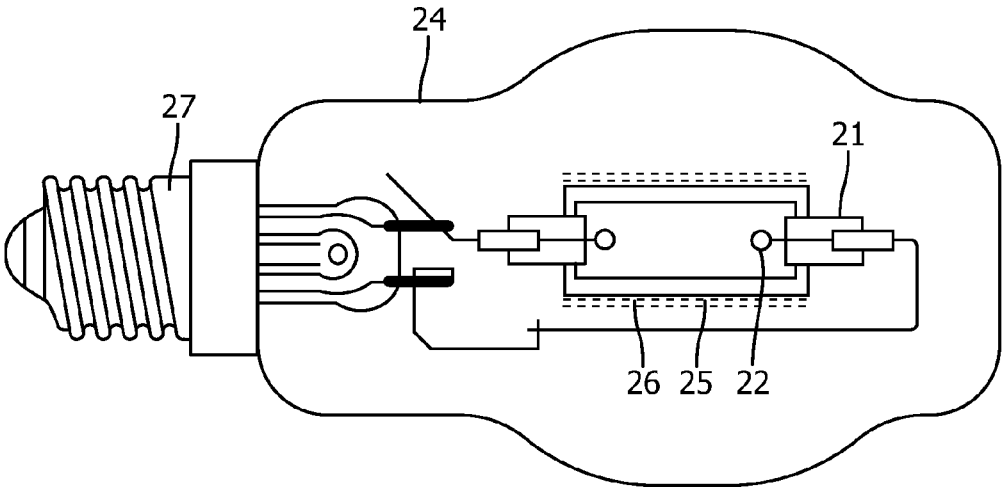
FIG. 3A shows a cross-sectional view of a third embodiment of the light source according to the invention.
Figure 3B:
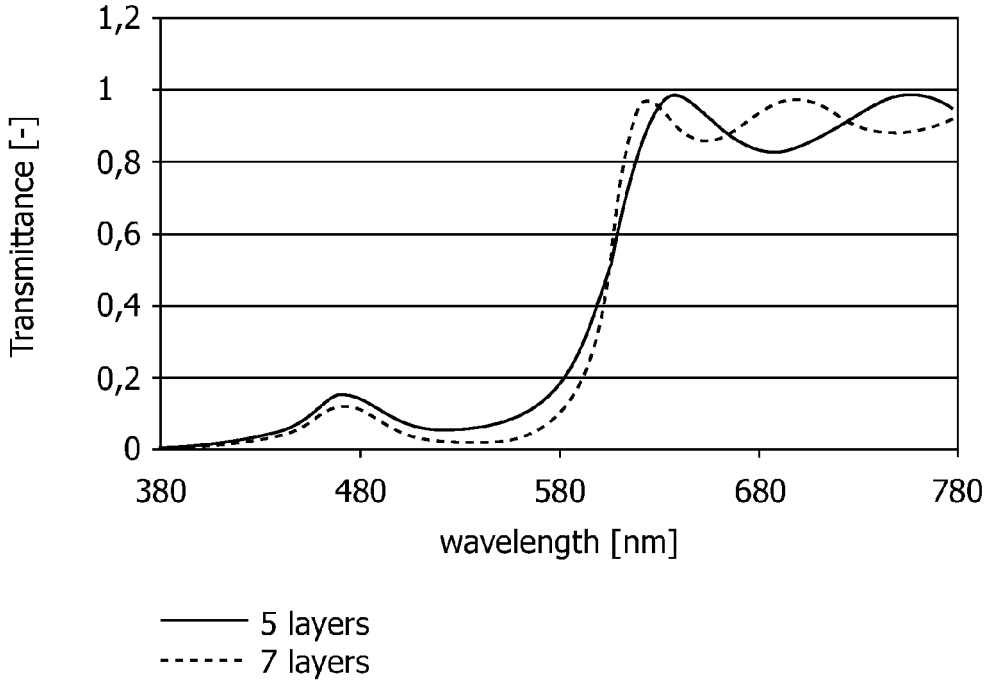
FIG. 3B shows transmission curves of a 5 layer and a 7 layer interference filter.

In FIG. 3A a third embodiment of the light source according to the invention comprises a high pressure sodium lamp, in this case a Philips 70 W color \828 CDO lamp as the lighting control element. The (HPS-) lamp comprises a pair of electrodes 22 arranged inside a lamp vessel 21 made of ceramic material, for example made of translucent, gastight alumina (TGA), the lamp vessel is enveloped by a hard glass outer bulb 24 provided with a lamp base 27. The (outer) surface 26 of the lamp vessel 21 is provided with an interference filter 25 as the at least one additional lighting control element, and comprises alternating layers of $Fe_2O_3/SiO_2$ and $SiO_2$, starting with a layer of $Fe_2O_3/SiO_2$, on the glass surface of the outer bulb 24. The lamp shown in FIG. 3A is provided via dip-coating with a 5-layer or, for example with a 7-layer interference filter. Possible compositions of the filter are shown in Table 3 and Table 4, and the transmission spectrum of both the 5-layer filter and the 7-layer filter are shown in FIG. 3B. Both said filters have a relatively high reflectance (low transmission) for light with a wavelength $\lambda$ in the range of 380 nm$\leq\lambda\leq$600 nm, their cut-off wavelength being approximately 600 nm. Very suitable filters have a cut-off wavelength in the range of 590 to 610 nm. Apparently the 7-layer filter is somewhat more transparent in the wavelength range 380 nm$\leq\lambda\leq$600 nm than the 5-layer filter.

TABLE 3

Composition of the 5 layer interference filter

| Layer | Material | Refractive Index [—] | Physical Thickness (nm) |
|---|---|---|---|
| | Air | | |
| 1 | $Fe_2O_3/SiO_2$ | 2.719 | 34.39 |
| 2 | $SiO_2$ | 1.462 | 276.6 |
| 3 | $Fe_2O_3/SiO_2$ | 2.719 | 67.34 |
| 4 | $SiO_2$ | 1.462 | 264.1 |
| 5 | $Fe_2O_3/SiO_2$ | 2.719 | 45.03 |
| Substrate: quartz glass | | 1.462 | |

The composition of the alternative 7-layer interference filter is shown in Table 4.

TABLE 4

Composition of the 7 layer interference filter

| Layer | Material | Refractive Index [—] | Physical Thickness (nm) |
|---|---|---|---|
| | Air | | |
| 1 | $Fe_2O_3/SiO_2$ | 2.712 | 30.09 |
| 2 | $SiO_2$ | 1.462 | 285.97 |
| 3 | $Fe_2O_3/SiO_2$ | 2.712 | 58.42 |
| 4 | $SiO_2$ | 1.462 | 263.1 |
| 5 | $Fe_2O_3/SiO_2$ | 2.712 | 62.28 |

TABLE 4-continued

| Composition of the 7 layer interference filter | | | |
|---|---|---|---|
| Layer | Material | Refractive Index [—] | Physical Thickness (nm) |
| | Air | | |
| 6 | $SiO_2$ | 1.462 | 286.54 |
| 7 | $Fe_2O_3/SiO_2$ | 2.712 | 30.9 |
| Substrate: quartz glass | | 1.462 | |

Figure 3C:
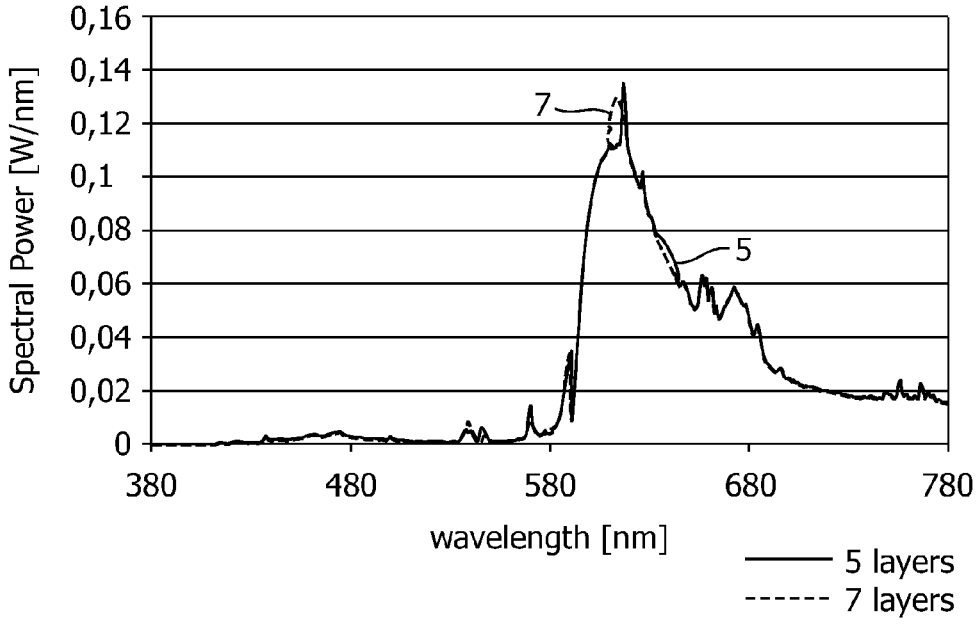
FIG. 3C shows emission spectra of the lamp of FIG. 3A provided with one of the layers having one of the transmission curves shown in FIG. 3B.

FIG. 3C shows the emission spectrum of the high pressure sodium lamp of FIG. 3A in combination with the 7-layer interference filter. Table 5 shows a summary of the spectral characteristics of the emission spectrum shown in FIG. 3C.

TABLE 5

| Characteristics of the emission spectra of the lamps of FIGS. 3C-3E. | | | | | | | | |
|---|---|---|---|---|---|---|---|---|
| Lamp type | Filter layers | Ra | Power short | Power medium | Power long | Coverage short | Coverage medium | Coverage long |
| 70 W CDO\828 | 7 | 50 | 2.0% | 3.6% | 94.4% | 34.4% | 44.7% | 100.0% |

In alternative embodiments, the interference filter is positioned at the inner or outer surface of the hard glass outer bulb 24. In other alternative embodiments, the interference filter is arranged at a position remote from the light source, for example on a transparent shroud around the light source, on the front glass of a light fixture or in between the light source and the front glass of a light fixture.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements. The invention may be implemented by means of hardware comprising several distinct elements. In the device claim enumerating several means, several of these means may be embodied by one and the same item of hardware. The mere fact that certain measures are recited in mutually different dependent claims does not indicate that a combination of these measures cannot be used to advantage.

The invention claimed is:

1. A light source for generating light having a spectral emittance in at least a part of the range of 380 nm to 680 nm, the light having a spectral power distribution E(λ) as a function of the wavelength λ, characterized in that the light source comprising a lighting control element and at least one additional lighting control element, the lighting control element and the at least one additional lighting control element being set to obtain generated light with a power distribution over a first range of 600 nm <=λ<680nm, a second range of 505 nm <=λ<600 nm, and a third range of 380 nm <=λ<505 nm , wherein a first ratio of the integral power distribution over said first range to that of a range of 380 nm <=λ<=680 nm is given by the relation:

$$\frac{\int_{600}^{680} E(\lambda)\,d\lambda}{\int_{380}^{680} E(\lambda)\,d\lambda} = P_1 \text{ wherein } 0.65 <= P_1 <= 0.95,$$

a second ratio of the integral power distribution over said second range to that of a range of 380 nm <=λ<=680 nm is given by the relation:

$$\frac{\int_{505}^{600} E(\lambda)\,d\lambda}{\int_{380}^{680} E(\lambda)\,d\lambda} = P_m \text{ wherein } P_m >= 0.08,$$

a third ratio of the integral power distribution over said third range to that of a range of 380 nm <=λ<=680 nm is given by the relation:

$$\frac{\int_{380}^{505} E(\lambda)\,d\lambda}{\int_{380}^{680} E(\lambda)\,d\lambda} = P_s \text{ wherein } P_s >= 0.03 \text{ or } P_s >= 0.015 \text{ if } P_1 >= 0.75$$

and each of the first, second and third range has a spectral coverage by the lighting control element respectively by the at least one additional lighting control element of at least 10%.

2. A light source as claimed in claim 1, characterized in that $0.70<=P_1<=0.95$.

3. A light source as claimed in claim 1, characterized in that the spectral coverage in each range is at least 20%.

4. A light source as claimed in claim 1, characterized in that for each range at least one significant emission peak has a FWHM >=12 nm.

5. A light source as claimed in claim 1, characterized in that the total flux of the light source is at least 100 lm.

6. A light source according to claim 1, characterized in that the light source comprises a plurality of LEDs as the first lighting control element, said first lighting control element being chosen from the group consisting of a red-orange LED and a red-LED, and the light source comprises an additional plurality of LEDs as the at least one additional lighting control element, said at least one additional lighting control element being chosen from the group consisting of a blue LED, a green LED and an amber LED.

7. A light source according to claim 1, characterized in that the light source comprises a plurality of LEDs as the first lighting control element, said first lighting control element being chosen from the group consisting of a red-orange LED and a red LED, and the light source comprises an additional plurality of LEDs as the at least one additional lighting control element, said at least one additional lighting control element being chosen from the group consisting of a cool white LED (CW) and a warm white LED (WW).

8. A light source according to claim 6, characterized in that the light source comprises at least one further additional lighting control element consisting of at least one LED not selected from either the group of the first lighting control element or the additional lighting control element.

9. A light source according to claim 1, characterized in that the light source is a low-pressure mercury vapor discharge lamp comprising a discharge vessel, the discharge vessel enclosing, in a gastight manner, a discharge space provided with an inert gas and mercury and comprising discharge means for maintaining a discharge in the discharge space, at least a part of a wall of the discharge vessel being provided with a luminescent layer comprising a mixture of a red emitting phosphor as the first lighting control element, and at least two phosphors chosen from a blue emitting phosphor, a green emitting, an amber emitting phosphor and a red-orange emitting phosphor as the one additional lighting control element and a further additional lighting control element.

10. A light source according to claim 1, characterized in that the light source is a high pressure ceramic metal halide lamp as the lighting control element provided with an interference filter as the at least one additional lighting control element which at least partly but not totally reflects or absorbs light with a wavelength $\lambda$ in the range of 380 nm$\leq\lambda\leq$600 nm and with a cut-off wavelength in the range of 590-610 nm, so as to prevent, at least partly, the light in said range from reaching the surroundings of the light source, said interference filter comprising alternating layers of $Fe_2O_3/SiO_2$ and $SiO_2$ provided on at least a part of an outer side of the lamp vessel.

* * * * *